US006543969B1

(12) United States Patent
Adam

(10) Patent No.: US 6,543,969 B1
(45) Date of Patent: Apr. 8, 2003

(54) MODULAR BLOCK

(76) Inventor: Paul Adam, 831 Shawn Dr., Jefferson City, MO (US) 65109

( * ) Notice: Subject to any disclaimer, the term of this patent is extended or adjusted under 35 U.S.C. 154(b) by 0 days.

(21) Appl. No.: 09/636,354

(22) Filed: Aug. 10, 2000

(51) Int. Cl.[7] ..... E02D 29/00; E04C 2/04

(52) U.S. Cl. ..... 405/284; 405/262; 405/286; 52/596; 52/606; 52/608; 52/747.12

(58) Field of Search ..... 405/16, 18, 258.1, 405/262, 272, 273, 284, 286, 287; 52/596, 603–608, 612, 747.12; 404/34, 39, 40, 41, 42; D25/113–118

(56) References Cited

U.S. PATENT DOCUMENTS

| | | | | | |
|---|---|---|---|---|---|
| 1,306,246 | A | * | 6/1919 | Bried | 52/603 |
| 3,390,502 | A | * | 7/1968 | Carroll | D25/117 X |
| 3,418,774 | A | * | 12/1968 | Kocher et al. | 52/608 X |
| 3,472,031 | A | * | 10/1969 | Kelso | 52/608 |
| 3,859,769 | A | * | 1/1975 | Watkins | 52/591.1 |
| 4,197,669 | A | * | 4/1980 | Hynes | 52/608 X |
| 4,429,506 | A | * | 2/1984 | Henderson | 52/589 |
| 4,537,001 | A | * | 8/1985 | Uppstrom | 52/608 X |
| 4,544,305 | A | * | 10/1985 | Hair | 404/41 |
| 4,925,338 | A | * | 5/1990 | Kapusta | 404/41 |
| D311,444 | S | * | 10/1990 | Forsberg | D25/113 |
| 5,054,957 | A | * | 10/1991 | Johnson, II | 404/41 |
| 5,252,017 | A | | 10/1993 | Hodel | 411/446 |
| 5,294,216 | A | | 3/1994 | Sievert | 405/286 |
| 5,456,555 | A | * | 10/1995 | Bokeler | 405/286 |
| 5,466,089 | A | * | 11/1995 | Jurik | 404/34 |
| 5,560,173 | A | * | 10/1996 | Scheiwiller | 52/608 |
| 5,568,999 | A | | 10/1996 | Egan et al. | 405/262 |
| 5,598,679 | A | * | 2/1997 | Orton et al. | 52/609 |
| 5,688,079 | A | * | 11/1997 | Bolduc et al. | 405/286 |
| 5,735,643 | A | * | 4/1998 | Castonguay et al. | 405/286 |
| 5,827,015 | A | | 10/1998 | Woolford et al. | 405/286 |
| 5,848,511 | A | | 12/1998 | Scales | 52/606 |
| 5,851,088 | A | | 12/1998 | Anderson et al. | 405/284 |
| 5,865,006 | A | | 2/1999 | Dawson | 52/604 |
| D421,806 | S | * | 3/2000 | Graf et al. | D25/113 |
| 6,149,352 | A | * | 11/2000 | MacDonald | 405/284 |
| 6,178,704 | B1 | * | 1/2001 | Sievert | 52/596 X |
| 6,183,354 | B1 | * | 1/2001 | Martin et al. | 405/284 |
| 6,183,168 | B1 | * | 2/2001 | Woolford et al. | 405/286 |

FOREIGN PATENT DOCUMENTS

| | | | | |
|---|---|---|---|---|
| JP | 56000412 | * | 1/1981 | 405/284 |

* cited by examiner

*Primary Examiner*—Jong-Suk (James) Lee
(74) *Attorney, Agent, or Firm*—Polster, Lieder, Woodruff & Lucchesi, L.C.

(57) ABSTRACT

A modular block comprises a first side, a second side, a third side, a fourth side, a top side, and a bottom side, the bottom side further comprising a primary score line, the primary score line for splitting the block into a pair of complimentary blocks with each of the complimentary blocks comprising a front split face surface and a pair of sides with the front split face surface and the side surfaces forming a triangular shaped block.

11 Claims, 3 Drawing Sheets

MODULAR BLOCK

BACKGROUND OF THE INVENTION

This invention relates to a modular block and more particularly to a modular block for constructing a retaining wall or other similar landscaping structure.

Retaining wall structures and similar landscaping structures have been constructed from various materials. Examples of such materials include railroad ties, steel rods or bars, poured concrete, rocks, stones, and preformed concrete blocks. In recent years the preformed concrete blocks have been popular because such blocks can be mass produced and are relatively inexpensive. Additionally, such blocks are as durable as concrete and have various finishes and colors. Even though these blocks are relatively inexpensive, they typically require complex installations to construct various landscaping structures. Further, due to the weight of the blocks, they are sometimes difficult to carry or handle when constructing a landscaping structure. Frequent hand or finger injuries occur when handling these blocks. Additionally, more than one type of block is typically required to construct a structure. Homeowners and commercial landscapers will avoid using numerous blocks due to the difficulty encountered in building a landscaping project or structure.

The present invention is designed to obviate and overcome many of the disadvantages and shortcomings associated with present wall blocks. In particular, the present invention is a modular block which may be used to easily construct various landscaping structures. Moreover, the modular block of the present invention can be employed to construct various complex landscaping structures and is easier to handle than currently available stones or blocks.

SUMMARY OF THE INVENTION

In one form of the present invention, a modular block comprises a front side, a top side, a bottom side, and a pair of sides with all of the sides forming a triangular shaped body, and the bottom side surface having a score line.

In another form of the present invention, a modular block comprises a first side having a split face surface, a second side having a split face surface, a top side, a bottom side, and a back side, with all of the sides forming a triangular shaped block.

In yet another form of the present invention, a modular block comprises a front side having a split face surface, a top side, a bottom side, and a pair of sides with all of the sides forming a triangular shaped block, and a hand hold formed in one of the pair of sides.

Another form of the present invention is a modular block which comprises a first side, a second side, a third side, and a fourth side, a top side, and a bottom side, the bottom side further comprising a primary score line, the primary score line for splitting the block into a pair of complimentary blocks with each of the complimentary blocks comprising a front split face surface and a pair of sides with the front split face surface and the side surfaces forming a triangular shaped block.

In another form of the present invention, a landscaping structure is disclosed which comprises a first course of modular blocks with each of the blocks comprising a front side having a split face surface, a top side, a bottom side, and a pair of sides with all of the sides forming a triangular shaped body, and the bottom side having a score line.

In light of the foregoing comments, it will be recognized that a principal object of the present invention is to provide a modular block which is of simple construction and design and which can be easily employed with highly reliable results.

Another object of the present invention is to provide a modular block that is easy to carry for use in both residential and commercial landscaping projects or applications.

A further object of the present invention is to provide a modular block which is capable of being manufactured using a mold with each mold being capable of producing two, four, or more of the modular blocks.

Another object of the present invention is to provide a modular block which can be used to construct various landscaping structures such as retaining walls, fences, sitting walls, and steps.

A still further object of the present invention is to provide a modular block that can be tumbled to present a natural or weathered appearance.

Another object of the present invention is to provide a modular block which can be used to construct a mortarless retaining wall structure having courses interlocked in a predetermined set-back relationship in a variety of straight or curved configurations.

A still further object of the present invention is to provide a modular block that can be used to construct various landscaping structures from a single set of identical blocks.

These and other objects and advantages of the present invention will become apparent after considering the following detailed specification in conjunction with the accompanying drawings, wherein:

DETAILED DESCRIPTION OF THE PREFERRED EMBODIMENTS

Figure 1:
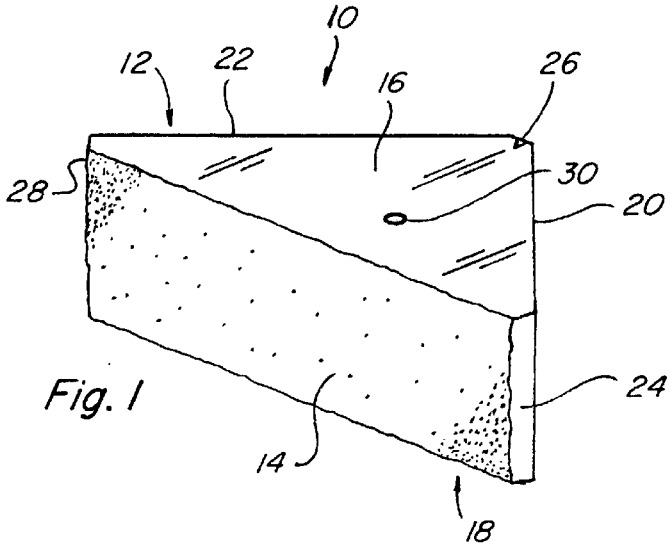
FIG. 1 is a perspective view of a preferred embodiment of a modular block constructed according to the present invention.

Referring now to the drawings, wherein like numbers refer to like items, number 10 identifies a preferred embodiment of a modular block 10 constructed according to the present invention. With reference now to FIG. 1, the modular block 10 has a triangular shaped block body 12 which comprises a front face or side 14, a top side 16, a bottom side 18, and a pair of sides 20 and 22 with all of the sides 14–22 forming the triangular shaped block body 12. The front face 14 has an irregular surface which resembles a natural product such as rock or stone and is known as a split face. The manner in which the split face is formed will be described herein. The block 10 also has three corners 24, 26, and 28 which are beveled which help prevent the block 10 from being broken or chipped during manufacturing, transportation, storage, or handling of the block 10. A passage 30 is also formed in the block 10 and runs through the entire body 12 between the top side 16 and the bottom side 18. The passage 30 allows a bar or pin to be inserted therein for use in constructing a landscaping structure, as will be explained.

The sides 20 and 22 are generally of the same dimensions. The top side 16 and the bottom side 18 are of the same general dimensions. The top side 16 and the bottom side 18 are also parallel to each other and separated from each other by the dimensions of the sides 20 and 22 and the front side 14.

Figure 2:
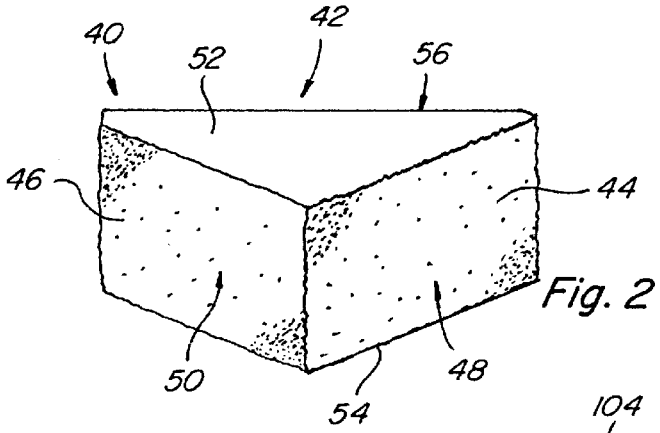
FIG. 2 is a perspective view of another preferred embodiment of a modular block constructed according to the present invention which may be used to construct a corner of a structure.

FIG. 2 shows a perspective view of a modular block 40 is shown wherein the block 40 is formed by splitting the block 10 into two separate blocks with one of the resulting blocks being the block 40. The block 40 has a triangular shaped block body 42 which comprises a pair of sides 44 and 46 having split faces 48 and 50, respectively, a top side 52, a bottom side 54, and a back side 56. The sides 44, 46, 52, 54, and 56 all form the triangular shaped block body 42. Although not shown with this particular block 40, it is also possible to manufacture a block similar to the block 40 with the one difference being that the similar block has the passage 30 which was shown in FIG. 1. The split faces 48 and 50 may be used to form a square corner when using the block 40 to form a wall structure. The back side 56 is actually the side 22 of the block 10 shown in FIG. 1 and the side 46 having the split face 50 is a portion of the side 14 of the block 10.

Figure 3:
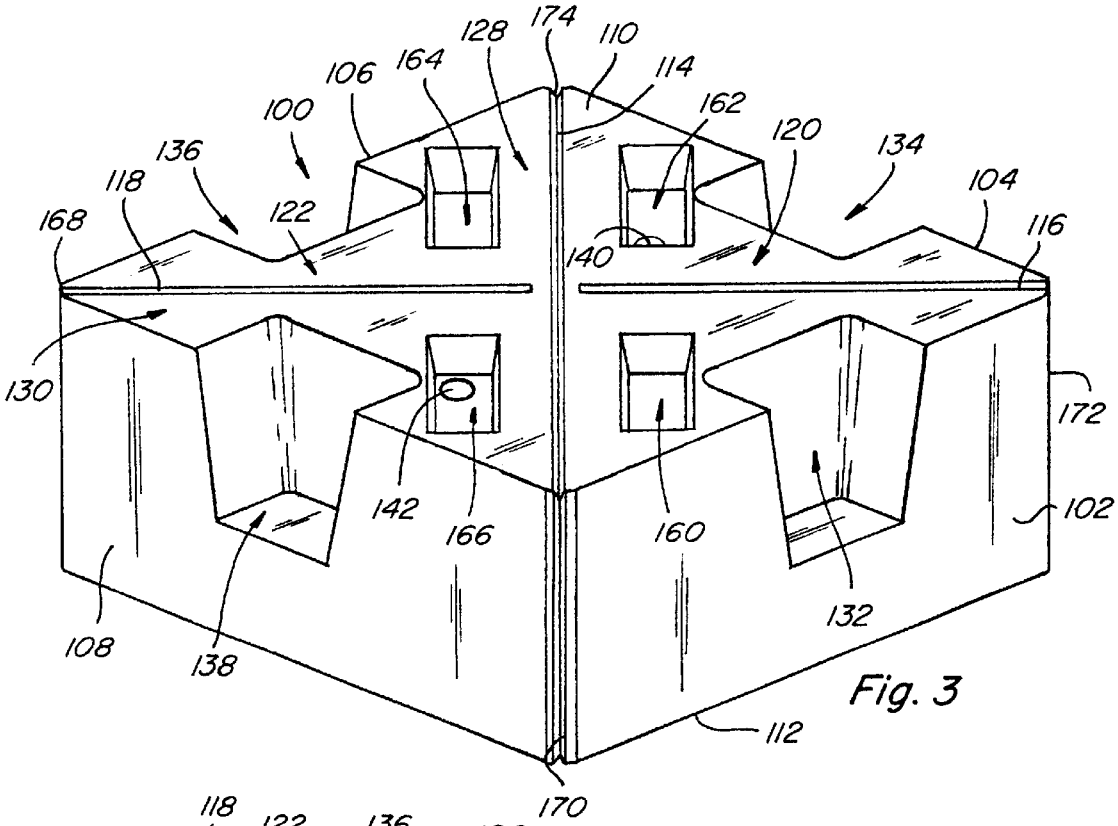
FIG. 3 is a perspective view of a modular ingot which is constructed according to the present invention and which is used to form either of the modular blocks shown in FIG. 1 or FIG. 2.
Figure 4:
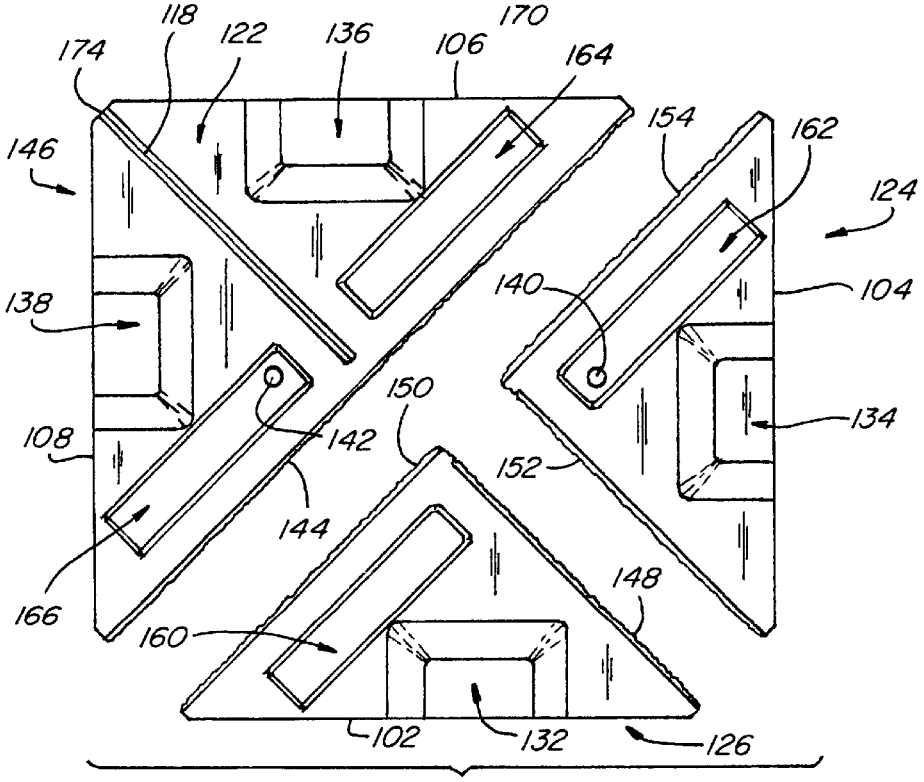
FIG. 4 is a top view of the modular ingot shown in FIG. 3 with the modular ingot being split apart to form either of the modular blocks shown in FIG. 1 or FIG. 2.

With reference now to both FIGS. 3 and 4, a modular ingot 100 is illustrated which is used to form the blocks 10 and 40. The modular ingot 100 is generally rectangular in shape and has four sides 102, 104, 106, and 108, a bottom side 110, and a top side 112. The bottom side 110 has a first or primary score line 114 and a pair of secondary score lines 116 and 118. The primary score line 114 is used to split the ingot 100 into two complimentary blocks 120 and 122. The two blocks 120 and 122 correspond to the modular block 10. The two blocks 120 and 122 each have one split face which are similar to the split face formed on the front side 14 of the block 10. The secondary score line 116 is used to split the block 120 into two more complimentary blocks 124 and 126 with the block 126 being similar to the block 40 and the block 124 being similar to the block 40 with one difference being the block 124 having a passage similar to the passage 30. The blocks 124 and 126 each has two split faces similar to the split faces 48 and 50 of the block 40. Additionally, the secondary score line 116 is used to split the block 120 into two more blocks 128 and 130 which are also each similar to the block 40. Again, the blocks 128 and 130 will each have two split faces.

Each of the sides 102, 104, 106, and 108 of the ingot 100 has a hand hold 132, 134, 138, and 136 respectively formed therein. The hand holds 132 and 134 are provided in the block 120 for grasping the block 120. Additionally, the hand holds 136 and 138 are incorporated within the block 122 for the same function. Even before the ingot 100 is split to form the blocks 120 and 122, all of the hand holds 132–138 may be used to facilitate lifting and carrying the ingot 100. The hand holds 132–136 may be of any shape which will facilitate an individual to better grasp or hold any of the blocks 10 or 40. As shown in FIG. 3, the hand holds 132–136 are of a generally rectangular shape having a tapered interior. The ingot 100 also includes a pair of passages 140 and 142, similar in construction to the passage 30, which are positioned on opposite sides of the primary score line 114. The passages 140 and 142 are adapted to receive rods or pins for use in constructing a landscaping structure.

The primary score line 114 runs the entire diagonal of the ingot 100 and ensures that the ingot 100 will be split into the two complimentary blocks 120 and 122. The secondary score lines 116 and 118 are formed such that they do not run the entire diagonal of the ingot 100. As discussed previously, the secondary score lines 116 and 118 are used to split the blocks 120 and 122 into the complimentary blocks 124, 126, 128, and 130.

The side 104 corresponds to the side 20 of the block 10 and the side 102 corresponds to the side 22. The sides 102–108 are generally of the same dimensions. The bottom 110 and the top are of the same general dimensions and are also parallel to each other and separated from each other by the dimensions of the sides 102–108. The ingot 100 does not have any split faces until the ingot 100 is separated into the two blocks 120 and 122 or the complimentary blocks 124, 126, 128, and 130.

Referring in particular to FIG. 4, the ingot 100 is shown being split apart into the block 122 and the block 120 is shown being split into the two blocks 124 and 126. As discussed above, the block 122 is similar to the block 10 and the blocks 124 and 126 are each similar to the block 40. The block 122 is shown to have a split face 144 and the sides 106 and 108 forming a generally triangular shaped body 146. The block 126 is depicted having a first split face 148 and a second split face 150. The split faces 148 and 150 and the side 102 form the triangular shaped block 126. Further, the block 124 also has a first split face 152 and a second split face 154. Again, the split faces 152 and 154 and the side 104 form the triangular shaped block 124. As can be appreciated, a single ingot or block 100 may be manufactured or formed and then split into either two blocks 120 and 122 or four blocks 124, 126, 128, and 130 or one block 120 and two blocks 128 and 130.

With reference again to both FIGS. 3 and 4, the modular ingot 100 also has formed on the bottom side 110 offset pockets 160, 162, 164, and 166. The pockets 160–166 are generally rectangular in shape and cross section and span across only a portion of the bottom side 110. The offset pockets 160–166 are used to construct a retaining wall structure in a tiered formation with each tier being set-back or offset from each other. The pockets 160–166 provide for a predetermined or preselected distance that each of the tiers will be set-back.

The ingot 100 also has beveled or generally V-shaped corners 168, 170, 172, and 174. The purpose of the corners 168–174 is to prevent the ingot 100 from being broken or chipped during either manufacturing, transportation, storage, or handling. Additionally, the corners 168–174 are used to be or to form the beveled corners 24, 26, and 28 of the block 10.

Figure 5:
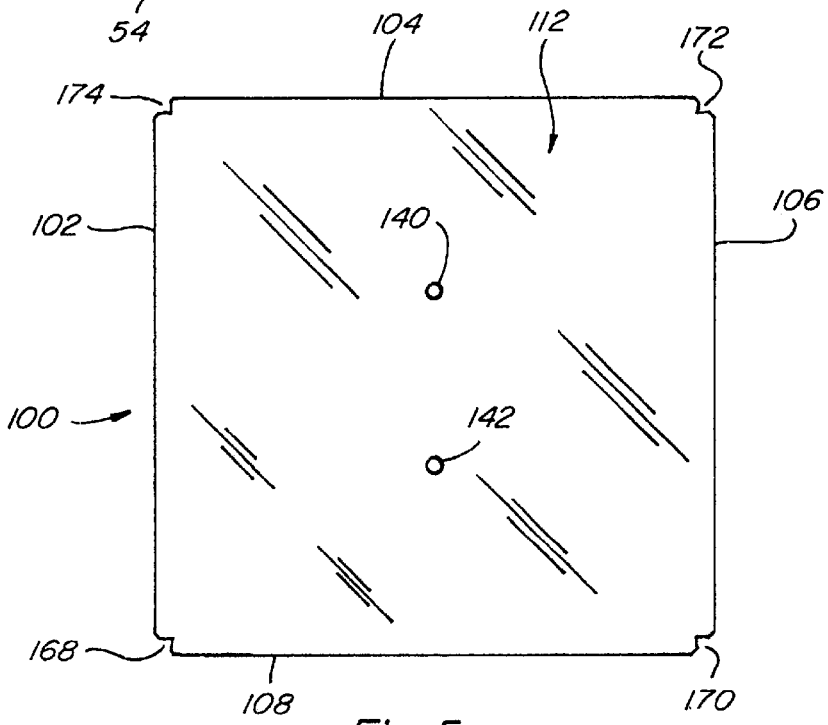
FIG. 5 is a top view of the modular ingot shown in FIG. 3.

A top view of the modular ingot 100 is illustrated in FIG. 5. The ingot 100 comprises the top side 112 and the sides 102–108. The passages 140 and 142 are also shown. Although only two passages 140 and 142 have been depicted and discussed, it is also possible and contemplated to have other similar passages formed in the ingot 100. It is also possible to manufacture a block not having any of the passages 140 and 142. In this case a modular block not having any passages could be used as a capstone for a landscaping structure.

Figure 6:
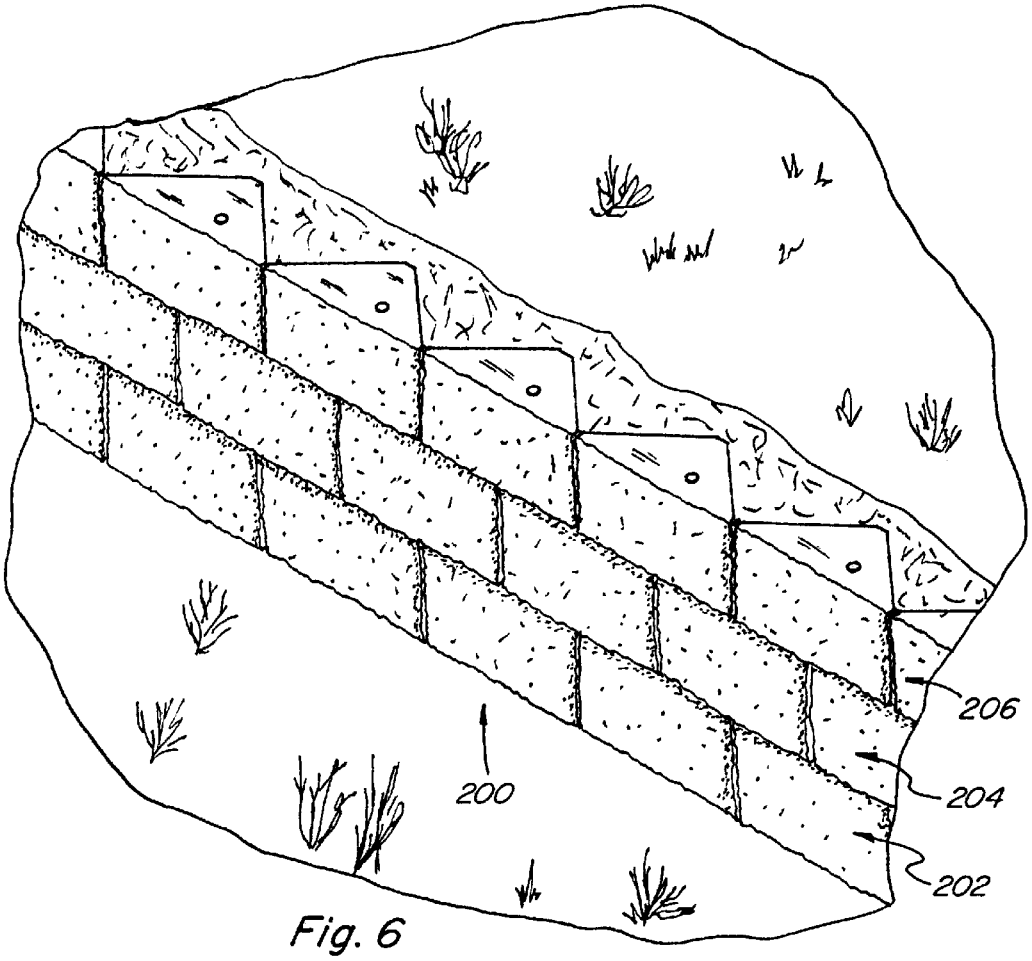
FIG. 6 is a partial perspective view of a retaining wall constructed with one embodiment of the modular block of the present invention.

FIG. 6 shows a retaining wall structure 200 which may be constructed using the modular block 10 of the present invention. The retaining wall structure 200 may be formed using a number of individual courses 202, 204, and 206 of the blocks 10 to build the structure 200 to any given height. The blocks 10 may be stacked on top of each other to form the wall structure 200. Other designs or shapes for various landscaping structures may be formed by using the blocks 10 or in combination with the blocks 40. Construction of the wall 200 is accomplished by using known construction methods. For example, a trench area may be excavated which approximates the size of the blocks 10. Footing material may be placed into the trench area to be compacted and leveled. A first layer or course 202 of the blocks 10 are then laid into the trench and then the ensuing individual course 204 of the blocks 10 is laid on top of the first course 202. To finish the wall structure 200, a top or cap row or course 206 may be formed by placing the blocks 10 over the course 204. Additionally, if the wall structure is a retaining wall, it is known to use material such as geogrid to help hold the soil retained by the wall in place. In this situation, the passage 30 may have a rod inserted therein and the geogrid material, which includes holes, can be placed through the rod. This helps to keep the geogrid in place and the weight of the block 10 also helps to hold the geogrid material in place.

Figure 7:
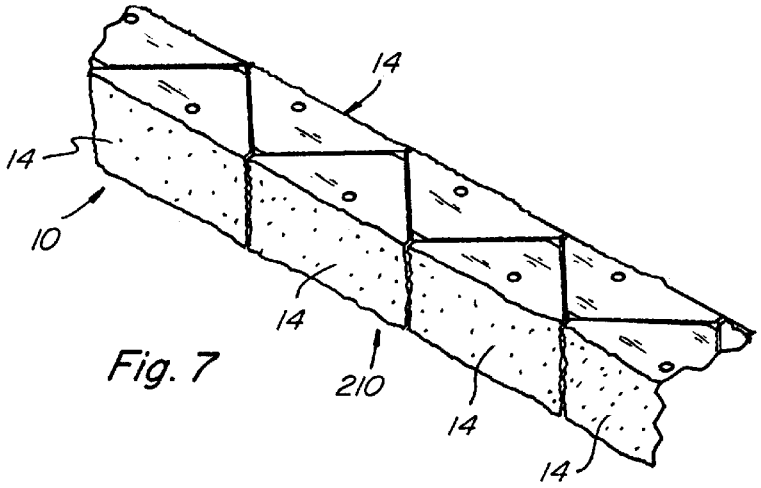
FIG. 7 is a partial perspective view of a single course of a retaining wall constructed with one embodiment of the modular block of the present invention.

A landscaping structure such as a straight wall structure 210 is shown in FIG. 7 to consist of the blocks 10 being placed side by side. In this manner, the straight wall structure 210 is able to have a finished look on both sides of the structure 210. In particular, the split faces 14 of the blocks 10 are presented on both sides of the structure 210. The blocks 10 may be stacked on top of each other to form the wall structure 210 of any desired height. Additionally, more blocks 10 may be used to build the wall structure 210 to any given thickness or height.

As can be appreciated, the ingot 100 of the present invention is formed by using a mold (not shown). The ingot 100 can be easily manufactured by casting or forming the modular ingot 100 using a suitable mold. Generally, the process entails molding the modular ingot 100 with a mixture of cement and water and other materials. The modular ingot 100 is casted by compressing and vibrating the mixture in a mold by the application of pressure to the mixture in a mold box in a block machine or similar machine. Once the ingot 100 is formed the ingot 100 may be cured through any method known in the art. For example, curing may take the form of air curing for a number of days or steam curing, but normally one day is allowed or needed for cure. Once cured, the ingot 100 may be split into pairs or the two complimentary blocks 120 and 122 by splitting along the score line 114. Some methods of splitting include using a manual chisel and hammer, a hydraulic splitting machine, or any other machine which can accomplish splitting. The groove or score line 114 provides a weak point which facilitates the splitting of the ingot 100. Additionally, splitting creates the split face surface 14 of the block 10 with the split face surface 14 resembling or mimicking some types of natural stone or rock.

Many combinations of concrete mixtures may be employed in manufacturing the ingot 100. Some considerations in determining the particular concrete mixtures include compression strength requirements, density, and shrinkage adsorption. Further, the costs of the materials, such as sand, gravel, cement, pigment additives, and rock have an impact on the mixture to be used. For example, gravel may be cheaper than river rock in some areas of the country and the ingot 100 may be formed of a mixture having more gravel than rock due to the difference in cost. The ingots 100 may be constructed with colored pigments to form different colored blocks. It should be recognized that the ingot 100 of the present invention may be constructed of various materials which are available. Preferably, the blocks 10 or 40 will be of relatively lightweight so that the blocks 10 or 40 can be easily manufactured, stored, transported, and stacked.

As can be appreciated, the blocks 10 and 40 of the present invention may be used for both commercial and residential use in building various landscape structures. The hand holds 132–138 provide an area for a commercial landscaper or a homeowner to easily grasp, carry, handle, stack, and place any of the blocks 10 or 40. The hand holds 132–138 are very useful and from a safety standpoint reduce hand and finger injuries related to grasping, handling, and placing the blocks 10 and 40. The dimensions of the ingot 100 are preferably 16 inches square which allows three of the ingots 100 to be placed side by side to arrive at a four foot or 48 inch span which is adapted to fit on a four foot pallet. This allows the ingots 100 to be stacked and transported on a four foot square pallet. This also means that no special or retrofitted pallets are required to stack or transport the ingots 100. Further, if the ingot 100 is split into either of the modular blocks 10 or 40 during the manufacturing process, then such resulting blocks 10 or 40 may also be stacked on a pallet for storage and transportation. In particular, eighteen of the blocks 10 may be stacked as a layer on a four foot square pallet or thirty-six of the blocks 40 may be stacked as a layer. It is also possible to stack combinations of the blocks 10 or 40 together on the same pallet.

Other advantages associated with the use of the modular blocks 10 and 40 include the reduced number of different components or parts which need to be manufactured, transported, storied, or inventoried. Since the ingot 100 can yield two to four different blocks from a single ingot or mold, manufacturing costs are significantly reduced. In particular, only one mold is required which can greatly reduce manufacturing costs. Being able to use the same block as the capstone also reduces the number of different kinds of blocks that must be manufactured to be used to build landscaping structures. The blocks 10 and 40 are also easy to install or build with and have multiple uses for various landscaping projects or structures. Examples of other landscaping projects or applications which may be constructed using the blocks 10 and 40 include circle planter boxes and other stone structures of over 16 inches in diameter such as tree rings, BBQ pits, or tetra ponds, steps, free standing walls, raised patios, patio barrier walls, fence posts, and stone fences.

Another particular aspect of the modular blocks 10 and 40 is that these blocks may be tumbled to give a natural appearance to the blocks. Once the ingot 100 is formed and split into either the blocks 10 or 40, the resulting blocks are put into a machine which tumbles the blocks together. After the tumbling process is complete, the blocks 10 or 40 may be used in the same manner as above described. Tumbling enhances the appearance of the blocks 10 and 40 and this allows the blocks to be sold at a premium.

From all that has been said, it will be clear that there has thus been shown and described herein a modular block which fulfills the various objects and advantages sought therefor. It will become apparent to those skilled in the art, however, that many changes, modifications, variations, and other uses and applications of the subject modular block are possible and contemplated. All changes, modifications, variations, and other uses and applications which do not depart from the spirit and scope of the invention are deemed to be covered by the invention, which is limited only by the claims which follow.

What is claimed is:

1. A complimentary modular block comprising a front side having a split face, surface which is split from a modular block by means of a score line a top side, a bottom side, and a pair of sides, with all of the sides forming a triangular shaped body, and the bottom side having a score line and an offset pocket formed entirely in the bottom side.

2. The complimentary modular block of claim 1 further comprising a passage which runs through the block between the top side and the bottom side.

3. The complimentary modular block of claim 2 wherein the passage is aligned with the offset pocket.

4. The complimentary modular block of claim 1 further comprising a second offset pocket formed entirely in the bottom side.

5. The complimentary modular block of claim 4 wherein the score line spans a portion of the bottom side.

6. A modular block comprising a first side, a second side, a third side, and a fourth side, a top side, and a bottom side, the bottom side further comprising a primary score line, the primary score line for splitting the block into a pair of complimentary blocks with each of the complimentary blocks comprising a front split face surface and a pair of sides with the front split face surface and the sides forming a triangular shaped block, the modular block further comprising a secondary score line formed in the bottom side, the secondary score line for splitting each of the pair of complimentary blocks into a second pair of complimentary blocks with each of the second pair of complimentary blocks comprising a first split face surface, a second split face surface, and a back side, the split face surfaces and the back side forming a triangular shaped block.

7. The modular block of claim 6 wherein the secondary score line extends along a portion of the bottom surface.

8. The modular block of claim 6 wherein the block has four corners and each corner is beveled.

9. A landscaping structure constructed from modular blocks each comprising a first side, a second side, a third side, and a fourth side, a top side, and a bottom side, the bottom side further comprising a primary score line, the primary score line for splitting the block into a pair of complimentary blocks with each of the complimentary blocks comprising a front split face surface and a pair of sides with the front split face surface and the sides forming a triangular shaped block, the modular block further comprising a secondary score line formed in the bottom side, the secondary score line for splitting each of the pair of complimentary blocks into a second pair of complimentary blocks with each of the second pair of complimentary blocks comprising a first split face surface, a second split face surface, and a back side the split face surfaces and the back side forming a triangular shaped block.

10. The landscaping structure of claim 9 wherein each of the modular blocks has an offset pocket formed in the bottom side.

11. The landscaping structure of claim 9 wherein each block has four corners and each corner is beveled.

* * * * *

UNITED STATES PATENT AND TRADEMARK OFFICE

CERTIFICATE OF CORRECTION

PATENT NO. : 6,543,969 B1
DATED : April 8, 2003
INVENTOR(S) : Paul Adam

It is certified that error appears in the above-identified patent and that said Letters Patent is hereby corrected as shown below:

Column 7,
Line 11, after the word "face" delete the ",".
Line 12, after the word "line" insert a -- , --.

Signed and Sealed this

Seventeenth Day of June, 2003

JAMES E. ROGAN
*Director of the United States Patent and Trademark Office*